US006502508B1

(12) United States Patent
Schaede et al.

(10) Patent No.: US 6,502,508 B1
(45) Date of Patent: Jan. 7, 2003

(54) CYLINDER DRIVE

(75) Inventors: Johannes Georg Schaede, Würzburg (DE); Elmar Johannes Anton Tober, Würzburg (DE); Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/868,926

(22) PCT Filed: Jan. 18, 2000

(86) PCT No.: PCT/DE00/00151

§ 371 (c)(1),
(2), (4) Date: Jul. 16, 2001

(87) PCT Pub. No.: WO00/41887

PCT Pub. Date: Jul. 20, 2000

(30) Foreign Application Priority Data

Jan. 18, 1999 (DE) ..... 199 01 618
Jun. 16, 1999 (DE) ..... 199 27 555

(51) Int. Cl.[7] ..... B41F 5/00
(52) U.S. Cl. ..... 101/216
(58) Field of Search ..... 101/216, 219, 101/248, 375, 376

(56) References Cited

U.S. PATENT DOCUMENTS

| | | | | |
|---|---|---|---|---|
| 3,196,788 A | | 7/1965 | Knowles | |
| 4,926,666 A | | 5/1990 | Gotting et al. | |
| 5,610,491 A | | 3/1997 | Gotz et al. | |
| 5,809,883 A | * | 9/1998 | Rodi | 101/216 |

FOREIGN PATENT DOCUMENTS

| | | |
|---|---|---|
| DD | 207 359 | 2/1984 |
| DE | 37 07 996 C1 | 10/1988 |
| DE | 0 295 449 A2 | 12/1988 |
| DE | 43 22 744 A1 | 1/1995 |
| DE | 195 01 243 A1 | 7/1996 |
| DE | 195 45 114 A1 | 6/1997 |

* cited by examiner

*Primary Examiner*—John Barlow
*Assistant Examiner*—Michael S. Brooke
(74) *Attorney, Agent, or Firm*—Jones, Tullar & Cooper, PC

(57) ABSTRACT

A cylinder drive for a rotary printing press uses bearing rings that are in contact with each other. A friction torque that is produced during the printing process, as a material passes between the cylinder which carry the bearing rings, is approximately compensated by an additional friction torque caused by the cooperating bearing rings.

35 Claims, 7 Drawing Sheets

CYLINDER DRIVE

FIELD OF THE INVENTION

The present invention relates to drive mechanisms for cylinders of a rotary printing press.

DESCRIPTION OF THE PRIOR ART

Cylinders of a rotary printing press with bearing rings are generally known from DE 195 01 243 A1. Additional lubricant is applied to these bearing rings as a function of a torque taken up by a drive motor of the cylinder.

DE 37 07 996 C2 discloses a device for affecting the bearing ring pressure in order to compensate for the effects of temperature changes.

DD 207 359 C describes cylinders of a web-fed rotary printing press with bearing rings of different sizes.

U.S. Pat. No. 3,196,788 discloses transfer cylinders of a printing press with two bearing rings of different size, wherein one bearing ring is assigned to the associated form cylinder, and the second bearing ring is assigned to the associated plate cylinder. In this case, bearing rings of equal size roll off on each other.

SUMMARY OF THE INVENTION

The object of the present invention is directed to providing drive mechanisms for cylinders of a rotary printing press.

The object is attained in accordance with the present invention by providing bearing rings for two cooperating cylinders of a rotary printing press. The ratio of the radiuses of the bearing rings lies within defined limits. A normal force between the two bearing rings can be changed in response to a torque sensed as acting on one of the cylinders.

The advantages which can be obtained by the present invention reside, in particular, in that, in connection with cooperating cylinders or cylinder groups, a power flow which occurs because of unwinding differences is suitably compensated directly between these cylinders. In connection with driving cylinders or cylinder groups, it is possible for unwinding differences to exist between the cylinders, so that a friction torque is created. These differences in the power consumption possibly can require considerable differences in the layout of the drive motors of the cooperating cylinders. For example, by the present invention, it is possible to employ identical drive motors with a reduced total output within a print unit.

With this arrangement, it is also possible to compensate for effects based on temperature differences and to prevent, in this way, an impermissible wear of bearing rings.

The fixed layout of diameters of different sizes of the bearing cylinders of cooperating cylinders is also advantageous in order to achieve power consumptions of approximately the same magnitude of the associated drive motors.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
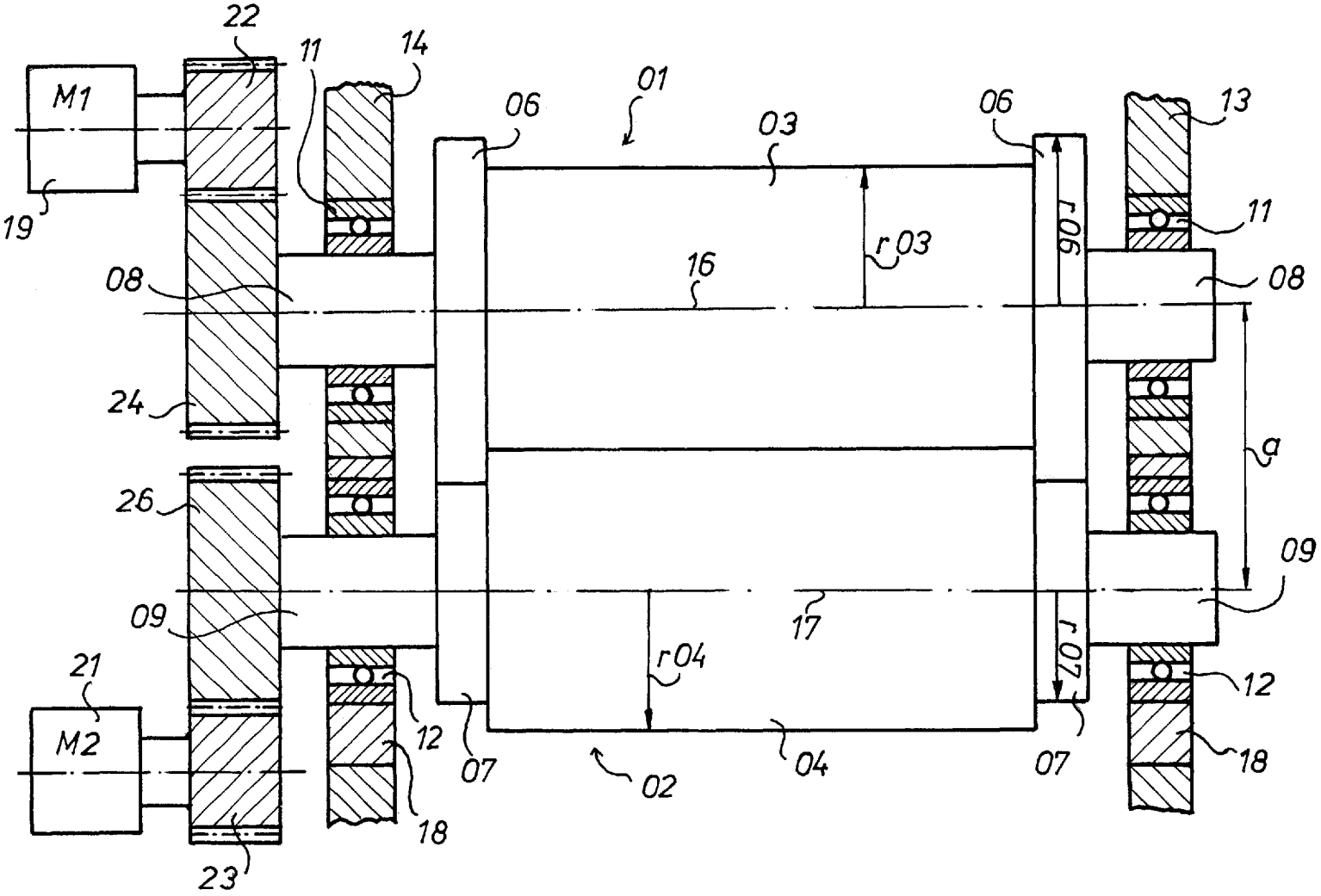
FIG. 1, a schematic representation of two cooperating cylinders of a rotary printing press in accordance with the present invention, FIG. 2, a schematic end view in accordance with FIG. 1, FIG. 3, a schematic representation of a nine-cylinder satellite print unit, FIG. 4, a schematic representation of a ten-cylinder satellite print unit, FIG. 5, a schematic representation of a preferred embodiment of a bearing ring whose diameter can be changed, FIG. 6, a schematic representation of a friction gear with additional friction wheels and in, FIG. 7, a schematic representation of a control circuit for adjusting the normal force between friction wheels.

A print position of a rotary printing press, as seen in FIG. 1, is constituted by a first cylinder 01, for example a counter-pressure cylinder 01, and a second cylinder 02, for example a transfer cylinder 02. These cylinders 01, 02 are each provided at both of the ends of their respective, cylinder barrels 03, 04 with a friction wheel 06, 07, a so-called bearing ring 06, 07. These bearing rings 06, 07 of adjoining cylinders 01, 02 roll off on each other in pairs and in this way act as a friction gear.

Figure 2:
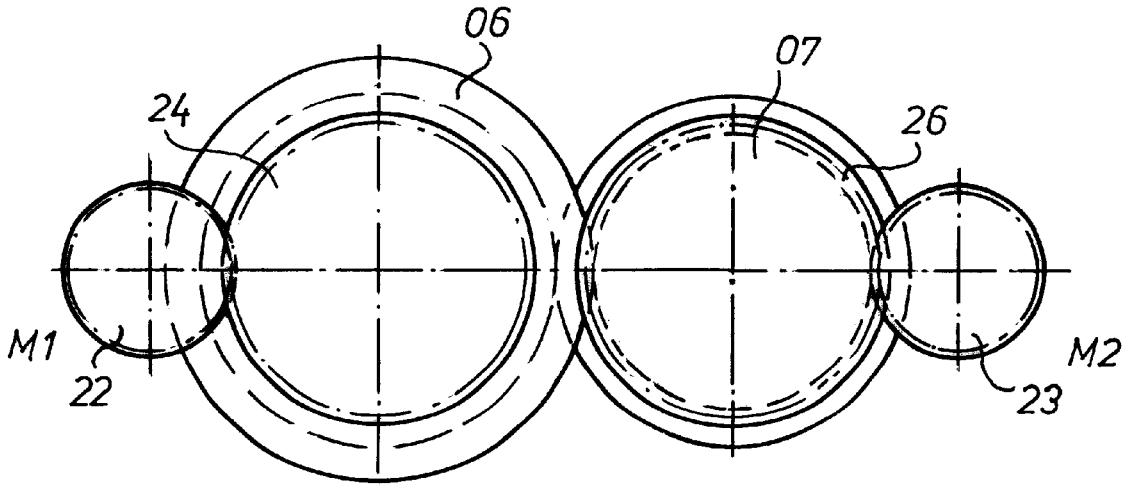

A radius r06, for example r06=200.2 mm, of both of the bearing rings 06 of the first cylinder 01 is not equal to a whole number multiple of a radius r07, for example r07= 199.8 mm of the bearing rings 07 of the second cylinder 02. A ratio of the radius r06 of the bearing rings 06 of the first cylinder 01 to a whole number multiple of the radius r07 of the bearing rings 07 of the second cylinder 02 is less than 1.02 and greater than 1.0005, preferably less than 1.01 and greater than 1.001, i.e. 1.01>r06/ (r07*N)>1.001. In the configuration of FIGS. 1, 2, the bearing rings 06, 07 are approximately of the same size, i.e. the whole number multiple N is 1, i.e. 1.01>r06/r07>1.001.

In an embodiment with these selected radii r06, r07, it is not absolutely necessary to change a contact force between the bearing rings 06, 07 after it had been previously set, for example during assembly, but it is optionally possible.

The barrels 03, 04 of a radius r03, for example r03= 200.025 mm, and r04, for example r04 200.115 mm, in the unloaded state of the cylinders 01, 02 act together and therefore constitute a first friction gear, subject to the process, as this term will be defined shortly, with a first gear ratio. The second additional friction gear, for example of the bearing rings 06, 07, having a second gear ratio, is superimposed on this friction gear of the barrels 03, 04 of the cylinders 01, 02. The gear ratio of the first friction gear, for example as a result of the radii r03 and r04 of the barrels 03, 04, is approximately the reverse of the gear ratio of the second friction gear, for example as a result of the radii r06 and r07 of the bearing rings 06, 07. The friction torque of the first friction gears is approximately compensated by the friction torque of the second friction gear.

"Subject to the process", for example, is understood to be the friction gear constituted by the barrels 03, 04 of the transfer cylinder 02 and the counter-pressure cylinder 01 with the interposition of a material to be printed existing during the printing process, or the friction gear existing between the form cylinder and transfer cylinders 02.

The cylinders 01, 02 are each provided with journals 08, 09, respectively which journals are seated in lateral frames 13, 14 with the aid of bearings 11, 12. An axial distance a1, for example a1=400.00 mm, between the axes of rotation 16, 17 of the two cylinders 01, 02 can be changed. To this end, the journals 09, for example, of at least one of the two cylinders 01, 02 for example of the transfer cylinder 02, are seated in pivotable eccentric bushings 18.

Each one of the two cylinders 01, 02 has its own, position-controlled drive motor 19, 21. In the present preferred embodiment, this drive motor 19, 21 has a pinion gear 22, 23, which meshes with a gear wheel 24, 26, which is connected, fixed against relative rotation, with the journal 08, 09 of the respective cylinder 01, 02. The gear wheels 24, 26 of the two cylinders 01, 02 do not engage, so that there is no interlocking drive connection between the two cylinders 01, 02.

It is also possible to employ other interlockingly or frictionally connected gears, for example a toothed belt gear, in place of the gear drive represented. It is also possible to connect the rotor of the drive motor 19, 21 directly with the associated journal 08, 09 of the respective cylinder 01, 02.

Figure 3:
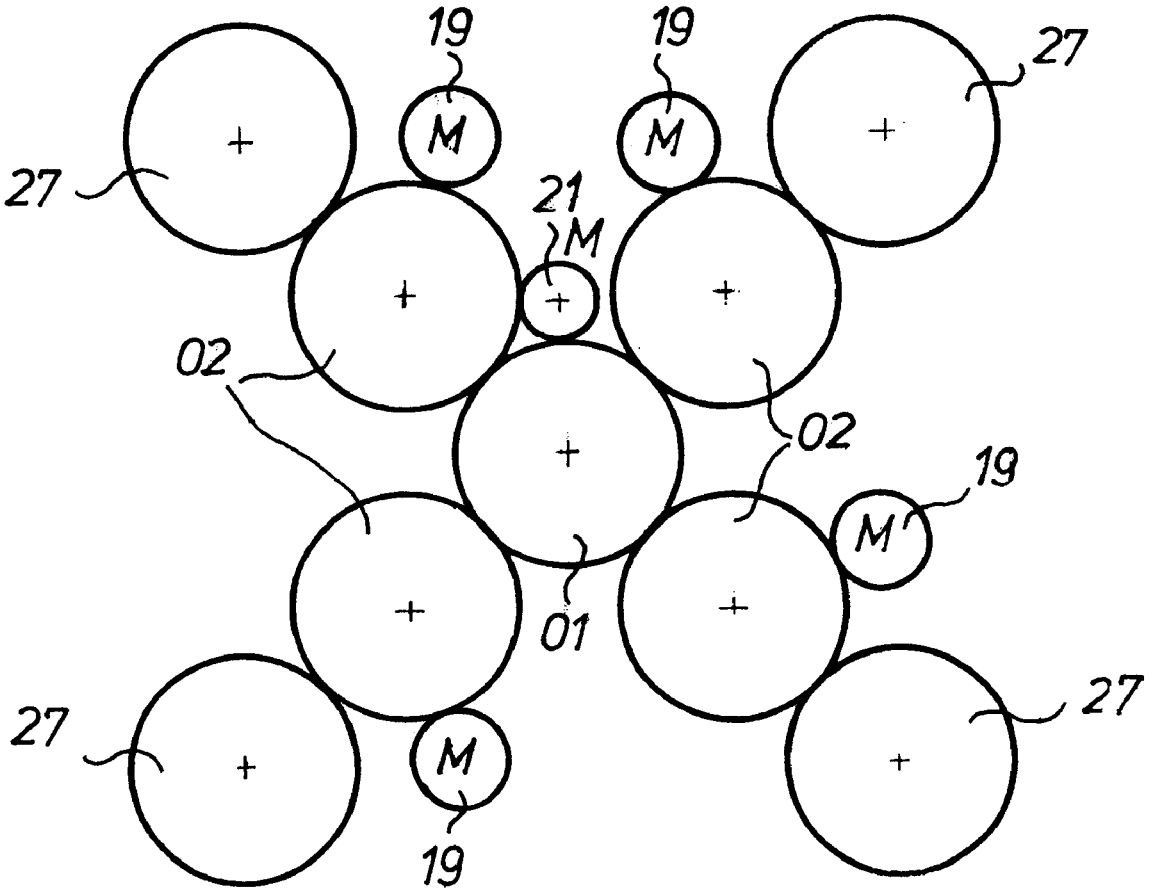
Figure 4:
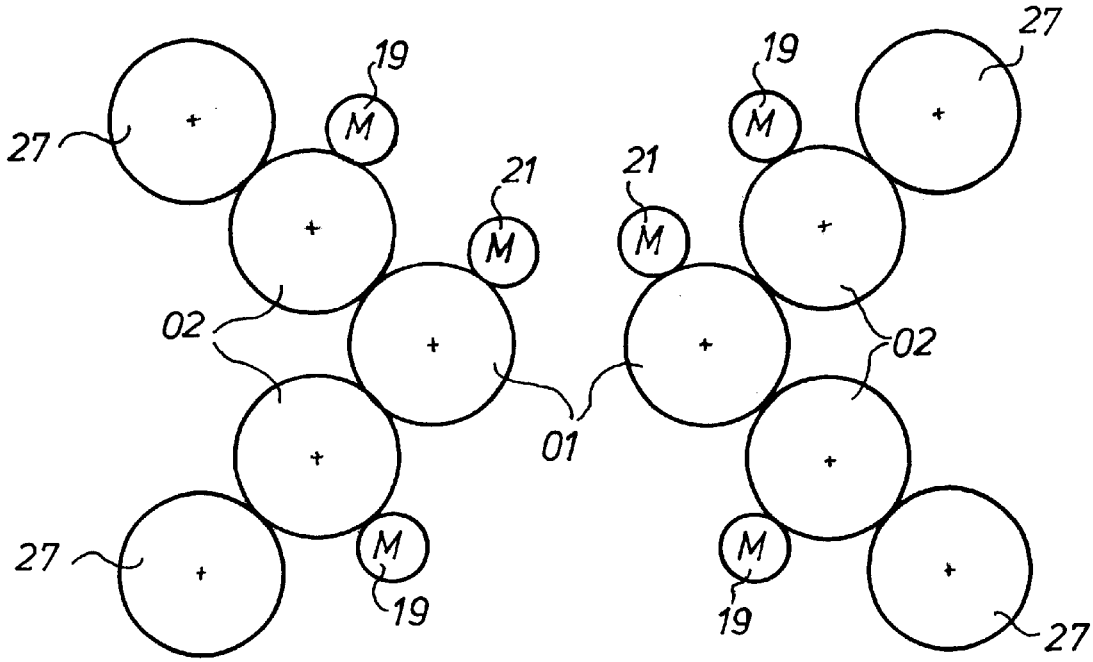

For example, as seen in FIG. 3 or 4, a forme cylinder 27 is assigned to the transfer cylinder 02. In the instant case the forme cylinder 27 is driven by a gear wheel from the transfer cylinder 02. However, the forme cylinder 27 can also be coupled in a non-interlocking manner with the transfer cylinder 02 and can have its own drive motor.

These print positions can, for example, be arranged in a five-cylinder print unit, a ten-cylinder print unit consisting of two five-cylinder print units as seen in FIG. 4, or a nine-cylinder print unit, as is depicted in FIG. 3.

In these preferred embodiments, each pair of forme cylinders 27 and transfer cylinders 02 is respectively assigned its own drive motor 21, and the associated counter-pressure cylinder 01 has its own drive motor 19, which is independent of the transfer cylinder 02.

Figure 5:
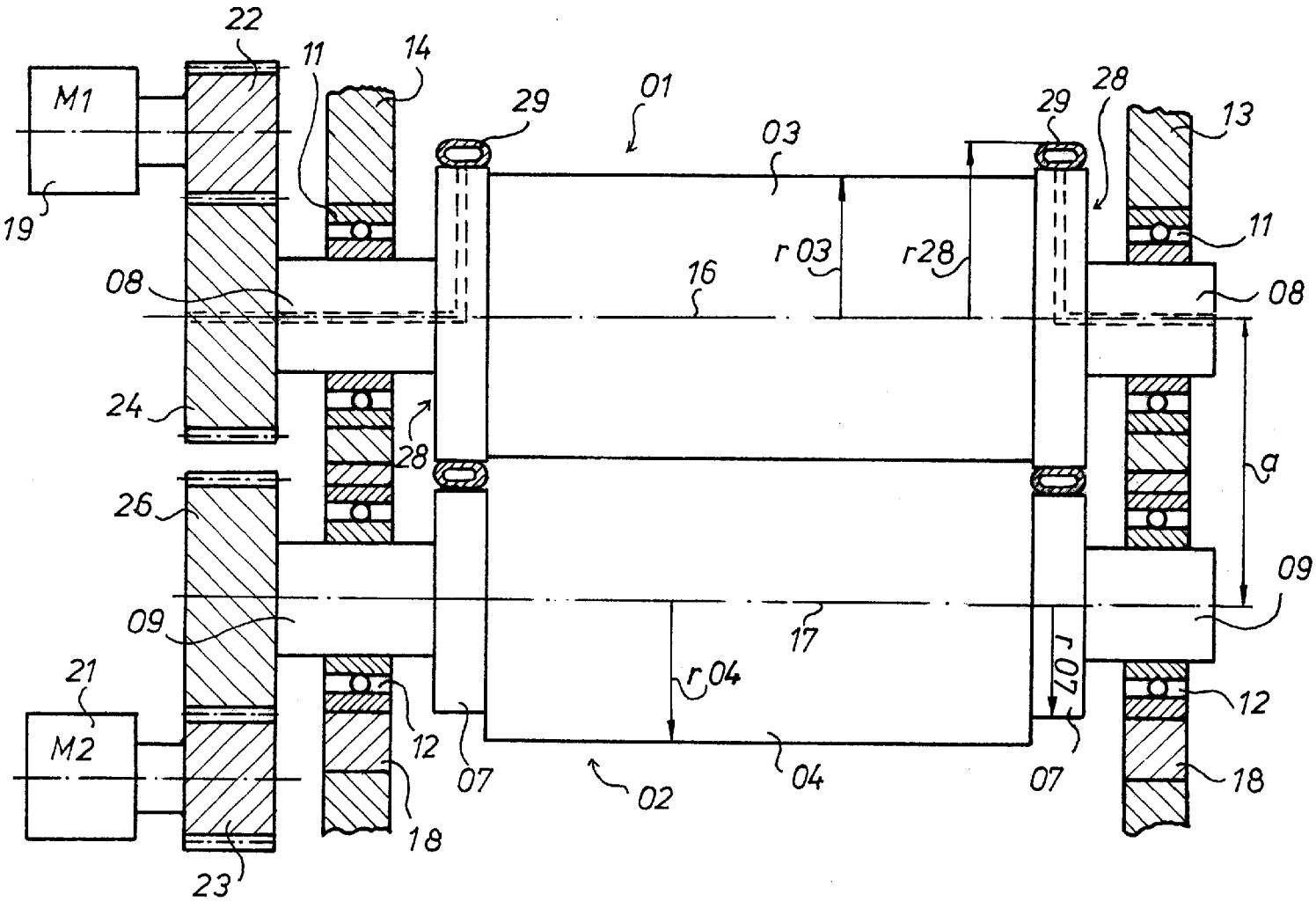

In one embodiment variation, as shown in FIG. 5, a contact pressure force between two friction wheels 28, 07 can be changed in that, for example, a roller surface of the friction wheel 28 has a tire 29, or a hose. This tire 29 can be charged with a pressure means, whose pressure, and therefore the radius r28 and the transferred torque of the friction wheel 28 can be adjusted.

Figure 6:
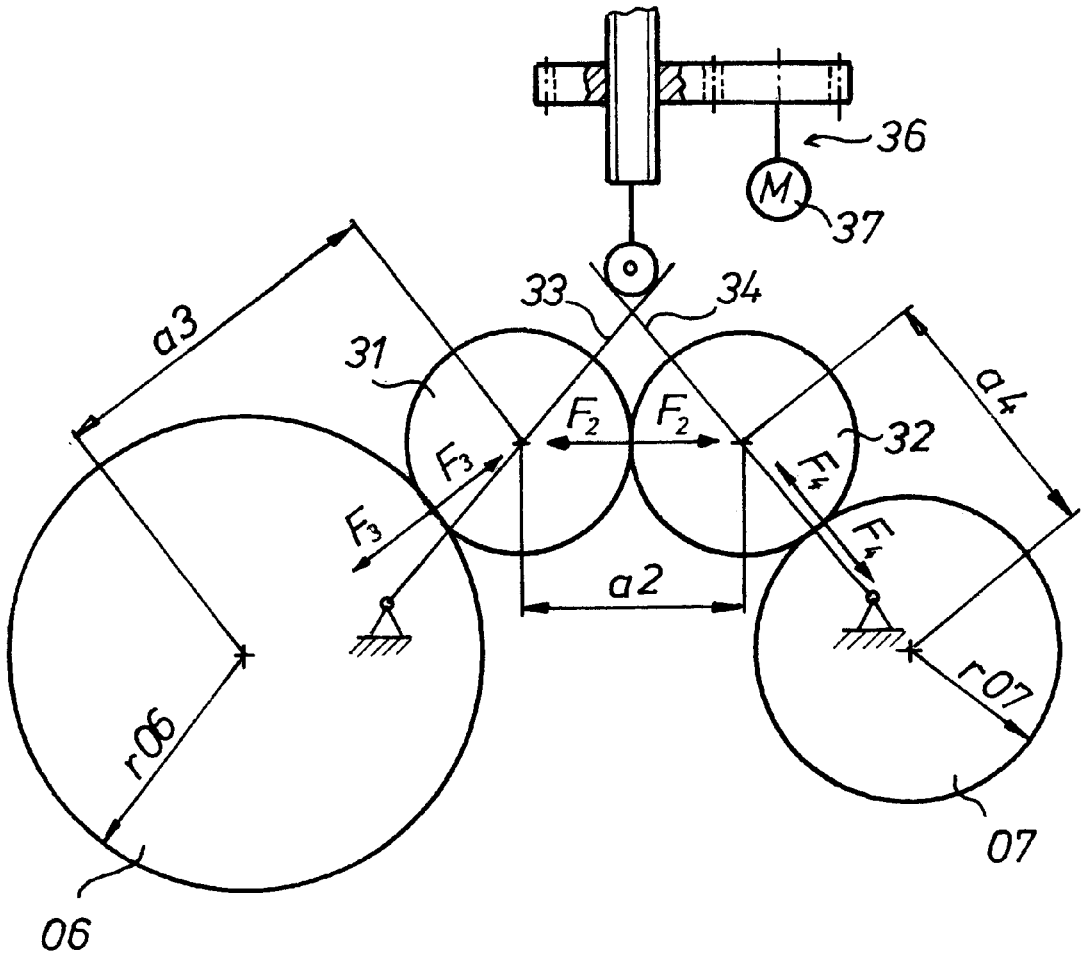

A further embodiment variation, as depicted in FIG. 6, has additional friction wheels 31, 32, which are in contact with the friction wheels 06, 07 arranged on the cylinders 01, 02, as well as with each other. For example, these friction wheels 31, 32 may be seated on pivotable levers 33, 34. Free ends of these levers 33, 34 are subjected to an adjustable force, so that an axial distance a2 and a contact pressure force F2 between the two additional friction wheels 31, 32 themselves, and axial distances a3, a4 and contact pressure forces F3, F4 between the additional friction wheels 31, 32 and the friction wheels 06, 07 arranged on the cylinders 01, 02, respectively, changes.

As in the first preferred embodiment, the friction wheels 06, 07 of the cylinders 01, 02 can additionally roll off on each other, or they can be spaced apart, as represented, wherein the barrels 03, 04 of the two cylinders 01, 02 work together.

In the preferred embodiments, the normal force between the two cooperating friction wheels 06, 07, or 28, 07, or 31, 32, is changed, i.e. the contact pressure force between two friction wheels 06, 07, or 28, 07, or 31, 32, and therefore the torque which can be transferred, can, for example, be set by use of a positioning drive 36, as is shown in detail in FIG. 6.

It is possible to achieve, by use of the specific selected arrangement, for example by a suitable selection of the bases, or fulcrums, of the pivot arms 33, 34, that the normal forces between the friction wheels 31, 32 and the respective friction wheel 06, 07 are higher than the normal forces between the friction wheels 06, 07. Because of this, the greatest portion of the slippage, and therefore also of the wear, occurs primarily between the friction wheels 31, 32 which, for example, are arranged in such a way that they can be replaced more simply and cheaper than the friction wheels 06, 07 arranged on the cylinders 01, 02.

To set the normal force between two friction wheels 06, 07, or 28, 07, or 31, 32, the torque of the drive motors 19, 21 is determined, for example by measuring their output. The normal force between the two friction wheels 06, 07, or 28, 07, or 31, 32, is changed as a function of a difference between the power consumption, or the torque yielded by the two drive motors 19, 21, of the two cooperating cylinders 01, 02, so that an amount of this difference between the two measured outputs and/or the yielded torques of the two drive motors 19, 21 preferably is minimal.

Figure 7:
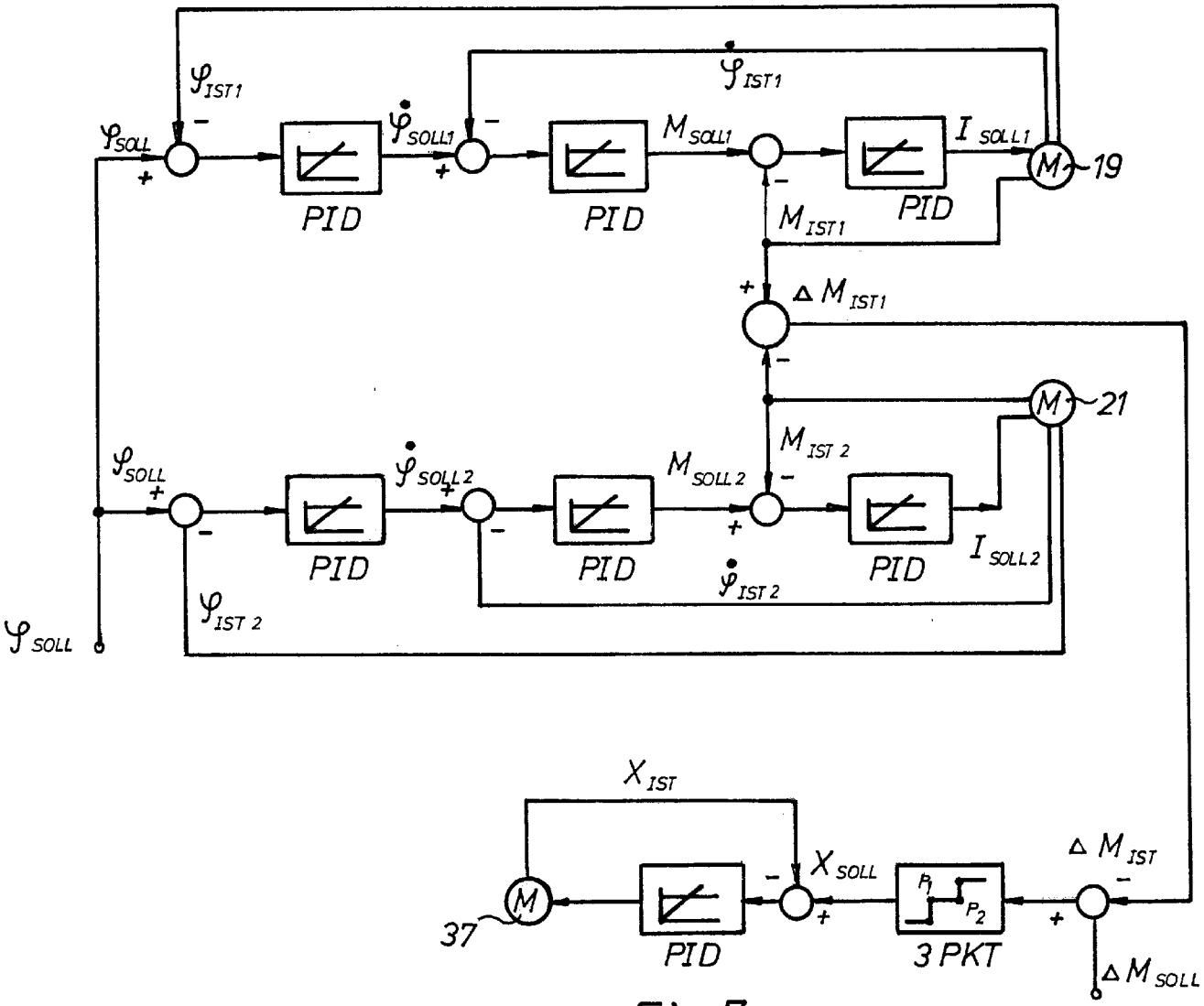

A preferred embodiment of a control circuit for accomplishing the regulation of the normal force between two friction wheels is schematically represented in FIG. 7.

A first adding station is loaded with a reference variable and an actual value of an angular position of the first drive motor 19, or the first cylinder 01, and sends a signal to a first PID controller. The output of the PID controller supplies a second adding station with a reference variable of an angular velocity. This second adding station is loaded with an actual value of the angular velocity and issues a signal to a second PID controller. The output of the second PID controller issues a reference variable of a torque to a third adding station. This third adding station is issued an actual value of the torque and sends a signal to a third PID controller. The output of the third PID controller provides a signal for fixing a reference variable of a current for the first drive motor 19. The control of the second drive motor 21, or cylinder 02, is performed in a similar manner.

In addition to the two control circuits for the first and second drive motors 19, 21, a third control circuit for adjusting the normal force between the friction wheels 06, 07, or 28, 07, or 31, 32, for example by means of the positioning drive 36, is provided. To this end, the actual values of the torques of the two drive motors 19, 21 are provided to an adding station and the difference between the two actual values of the torques is formed. This difference of the actual values and a reference variable of this difference of the torques of the two drive motors 19, 20 is supplied to a further adding station, and its output value is loaded into a three-point controller. The output of the three-point controller supplies a signal for a reference variable of a manipulated variable, for example a position, pressure or force. This adding station is loaded with the actual value of this reference variable, in the present case the position. From this adding station the input of a PID controller is loaded which, in turn, controls a drive motor 37 of the positioning drive 36, or a pressure control valve, for example.

In place of the present preferred embodiments with separate drive motors 19, 21 for the cooperating cylinders 01, 02, these cylinders 01, 02 can also be driven by an interlocking gear, for example gear wheels. In this case, a torque transmitted by the cylinders 01, 02 or gear wheels is determined in place of the recorded torque from the drive motors 19, 21 and used for setting the contact pressure of the bearing rings.

While preferred embodiments of a cylinder drive in accordance with the present invention have been set forth fully and completely hereinabove, it will be apparent to one of skill in the art that a number of changes in, for example, the specific type of printing press used, the nature of the material web being printed and the like could be made without departing from the true spirit and scope of the present invention which is accordingly to be limited only by the following claims.

What is claimed is:

1. A cylinder drive for cylinders of a rotary printing press comprising:

first and second cooperating cylinders;

first bearing rings on said first cylinder, said first bearing rings having a first radius;

second bearing rings on said second cylinder, said second bearing rings having a second radius, said first and second bearing rings being in contact;

a ratio between said first radius and a whole number multiple of said second radius, said ratio being greater that 1.0001 and less than 1.02;

a first angular position controlled drive motor for said first cylinder; and a second angular position controlled drive motor for said second cylinder.

2. The drive mechanism of claim 1 wherein said first cylinder and said second cylinder have no interlocking drive connector.

3. The drive mechanism of claim 1 further including a separate drive motor for each of said first and second cylinders.

4. The drive mechanism of claim 1 wherein said ratio is less than 1.01 and greater than 1.001.

5. The drive mechanism of claim 1 further wherein said first bearing rings have a first axis of rotation and further wherein said second bearing rings have a second axis of rotation, and means for changing a distance between said first and second axes of rotation.

6. The drive mechanism of claim 5 wherein said means for changing said distance is an eccentric bushing.

7. The drive mechanism of claim 1 wherein a radius of at least one of said first and second bearing rings can be changed.

8. The drive mechanism of claim 1 further including additional friction wheels cooperating with said first and second bearing rings.

9. The drive mechanism of claim 1 further including additional friction wheels cooperating with said first and second bearing rings.

10. A drive mechanism for cylinders of a rotary printing press comprising:

first and second cooperating cylinders;

a first friction gear with a first gear ratio associated with said first cylinder;

a second friction gear with a second gear ratio associated with said second cylinder, said first friction gear generating a first friction torque and said second friction gear generating a second friction torque during printing of a material by said first and second cooperating cylinders, said first gear ratio being the reverse of said second gear ratio, said first friction torque being compensated by said second friction torque.

11. The drive mechanism of claim 10 further including a first angular position-controlled drive motor for said first cylinder and a second angular position-controlled drive motor for said second cylinder.

12. The drive mechanism of claim 10 wherein said first cylinder is one of a counter-pressure cylinder and a first transfer cylinder and said second cylinder is a second transfer cylinder.

13. The drive mechanism of claim 12 further including a forme cylinder and further including an interlocking drive connection between said forme cylinder and said second transfer cylinder.

14. The drive mechanism of claim 13 further including an angular position-controlled drive motor for said forme cylinder and said second transfer cylinder.

15. The drive mechanism of claim 10 wherein said first cylinder and said second cylinder have no interlocking drive connector.

16. The drive mechanism of claim 10 further including a separate drive motor for each of said first and second cylinders.

17. A drive mechanism for cylinders of a rotary printing press comprising:

first and second cooperating cylinders;

first bearing rings on said first cylinder;

second bearing rings on said second cylinder;

a normal force between associated ones of said first and second bearing rings which roll on each other; and means for changing said normal force as a function of one of a detected output of a drive motor of one of a said first and second cylinders and a detected torque acting on one of said first and second cylinders.

18. The drive mechanism of claim 17 further including a first angular position-controlled drive motor for said first cylinder and a second angular position-controlled drive motor for said second cylinder.

19. The drive mechanism of claim 17 further including a first drive motor for said first cylinder and a second drive motor for said second cylinder and wherein said normal force can be set as a function of an amount of difference between detected outputs of said first and second drive motors.

20. The drive mechanism of claim 17 wherein said first cylinder is one of a counter-pressure cylinder and a first transfer cylinder and said second cylinder is a second transfer cylinder.

21. The drive mechanism of claim 20 further including a forme cylinder and further including an interlocking drive connection between said forme cylinder and said second transfer cylinder.

22. The drive mechanism of claim 21 further including an angular position-controlled drive motor for said forme cylinder and said second transfer cylinder.

23. The drive mechanism of claim 17 wherein said first cylinder and said second cylinder have no interlocking drive connector.

24. The drive mechanism of claim 17 further including a separate drive motor for each of said first and second cylinders.

25. The drive mechanism of claim 17 further wherein said first bearing rings have a first axis of rotation and further wherein said second bearing rings have a second axis of rotation, and means for changing a distance between said first and second axes of rotation.

26. The drive mechanism of claim 25 wherein said means for changing said distance is an eccentric bushing.

27. The drive mechanism of claim 17 wherein a radius of at least one of said first and second bearing rings can be changed.

28. A drive mechanism for cylinders of a rotary printing press comprising:

first and second cooperating cylinders;

a first friction gear associated with said first cylinder;

a second friction gear associated with said second cylinder, said first and second friction gears accomplishing a torque transmission between said first and second cooperating cylinders;

a normal force between said first and second friction gears; and means for changing said normal force as a function of one of a detected output of a drive motor of one of said first and second cylinders and a detected torque acting on one of said first and second cylinders.

29. The drive mechanism of claim 28 further including a first angular position-controlled drive motor for said first cylinder and a second angular position-controlled drive motor for said second cylinder.

30. The drive mechanism of claim 28 further including a first drive motor for said first cylinder and a second drive motor for said second cylinder and wherein said normal force can be set as a function of an amount of difference between detected outputs of said first and second drive motors.

31. The drive mechanism of claim 28 wherein said first cylinder is one of a counter-pressure cylinder and a first transfer cylinder and said second cylinder is a second transfer cylinder.

32. The drive mechanism of claim 31 further including a forme cylinder and further including an interlocking drive connection between said forme cylinder and said second transfer cylinder.

33. The drive mechanism of claim 32 further including an angular position-controlled drive motor for said forme cylinder and said second transfer cylinder.

34. The drive mechanism of claim 28 wherein said first cylinder and said second cylinder have no interlocking drive connector.

35. The drive mechanism of claim 28 further including a separate drive motor for each of said first and second cylinders.

* * * * *